United States Patent [19]

Bodyako et al.

[11] 4,369,074

[45] Jan. 18, 1983

[54] METHOD OF PRODUCING BELLOWS FROM METAL ALLOYS

[76] Inventors: Mikhail N. Bodyako, Leninsky prospekt, 76, kv. 105, Minsk; Gennady P. Alexeev, ulitsa Nikolaeva, 19, kv. 117; Mikhail P. Goncharov, prospekt Stroitelei, 18, kv. 21, both of, Smolensk; Stanislav A. Astapchik, ulitsa Kalinovskogo, 56, kv. 79, Minsk; Oleg S. Zinkevich, ulitsa Chernyakhovskogo, 1, kv. 60; Margarita R. Kushelman, ulitsa Nikolaeva, 42, kv. 48, both of, Smolensk; Viktor V. Krylov-Ole-Firenko, Leninsky prospekt, 143, kv. 47, Minsk; Jury P. Minchenkov, ulitsa Dzerzhinskogo, 5, kv. 60, Smolensk; Viktor P. Bozhok, ulitsa Kalinina, 21, kv. 28, Minsk; Zoya M. Iedlinskaya, Kutuzovsky prospekt, 24, kv. 407, Moscow; Sergei M. Kashulin, ulitsa Gorkogo, 143, kv. 151, Minsk; Ljudmila M. Fursova, prospekt Kalinina, 43, kv. 8, Dnepropetrovsk; Vladimir M. Rozenberg, ulitsa Baikalskaya, 40/17, kv. 76; Alla V. Chernikova, Otkrytoe shosse, 21, korpus 2, kv. 113, both of Moscow, all of U.S.S.R.

[21] Appl. No.: 278,482

[22] Filed: Jun. 29, 1981

[51] Int. Cl.[3] ..... C21D 9/08

[52] U.S. Cl. ..... 148/11.5 C; 148/12 E; 148/12 EA

[58] Field of Search ..... 148/11.5 R, 11.5 C, 148/12 E, 12 EA

[56] References Cited

U.S. PATENT DOCUMENTS 3,774,431 11/1973 Stromblad et al. ..... 148/11.5 C 4,202,708 5/1980 Bates et al. ..... 148/11.5 C

*Primary Examiner*—W. Stallard

*Attorney, Agent, or Firm*—Lilling & Greenspan

[57] ABSTRACT

A method of producing bellows from metal alloys comprises reeling a tubular workpiece to reduce the wall thickness thereof under volume deformation, heating the reeled tubular workpiece at a rate of 100 to 800° C. per sec by passing electric current therethrough up to a temperature exceeding the recrystallization of the alloys, and cooling the heated tubular workpiece. Thereafter, the tubular workpiece wall is locally deformed in a transverse direction to form annular grooves thereon, and then corrugations are made by plastically deforming the tubular workpiece under axial compression and under excessive internal pressure produced therein. Thus obtained corrugated workpiece is heated by passing electric current therethrough at a rate of 25 to 100° per sec up to a temperature at which finely dispersed phases of the alloy precipitate at a maximum rate, and held at the above temperature for 0.5 to 120 min.

9 Claims, No Drawings

METHOD OF PRODUCING BELLOWS FROM METAL ALLOYS

BACKGROUND OF THE INVENTION

1. Field of the Invention

The present invention relates to methods of producing thin-walled resilient sensitive elements, and particularly to methods of producing bellows from metal alloys.

Most advantageously the invention may be used in instrument manufacture.

2. Description of the Prior Art

Though the methods of making bellows on an industrial scale have been mastered long ago, the amount of defective products obtained when using these methods is still as high as 40 to 70% of the total amount of the manufactured products.

It is well known that bellows, being sensitive elements of many various devices, should retain their properties (rigidity, sealing, proportionality between the elastic deformation and the load applied) in a wide range of temperatures and pressures under prolonged static and dynamic loads in various weather conditions and in various agressive media. It is due to the above that bellows should meet rather rigid requirements. The quality of a bellow depends mainly on production techniques and on the properties of the metal alloy used for making it. Many attempts have been made to improve the production procedure for making bellows but all of them failed to considerably reduce the above percentage of defective products.

Known in the art is a method of producing bellows from a plurality of shaped annular diaphragms (see Burtsev K.N., Metallicheskie silfony, "Mashgiz", Moskva, Leningrad, 1963, pp. 6, 7, 80–82). According to this method, the annular diaphragms are welded together along the inner and outer edges thereof.

Though this method is in general use and the welding conditions are worked out to a rather high degree, the great amount of joint welds makes checking the manufactured product very difficult and in most cases is responsible for a loss of sealing.

There is also known in the art a method of producing bellows from metal alloys without welding (see Burtsev K.N., Metallicheskie silfony, "Mashgiz", Moskva, Leningrad, 1963, pp. 83–125). According to this method, a tubular workpiece is reeled to reduce the wall thickness thereof under volume deformation. The reeled tubular workpiece is heated up to a temperature exceeding that of recrystallization of the alloy. The heating process is carried out in a muffle furnace at a rate of 10° to 20° C. per sec. The thus heated tubular workpiece is cooled down in water. The tubular workpiece wall is locally deformed in a transverse direction to form annular grooves therein. Then the inner space of the tubular workpiece is filled with a fluid, and excessive pressure is produced within said inner space. The workpiece is compressed on axial direction, which causes plastic deformation of its wall, and thus corrugations are made. The corrugated workpiece is heated to a temperature at which finely dispersed phases of the alloy precipitate at a maximum rate. The heating process is carried out in a vacuum furnace at a rate of 1° to 1.5° C. per sec, the workpiece being held in a special clamping device which allows the same workpiece to acquire predetermined sizes. At the above temperature at which finely dispersed phases of the alloy precipitate at a maximum rate, the corrugated workpiece is held for 4 to 5 hours. The bellows thus produced have no joint welds, and, hence, the possibility of a loss of sealing, in this case, is somewhat lower. Also, the procedure of checking such bellows is much easier. However, the production procedure under consideration does not allow for any reduction in the percentage of defective products either. In particular, such deficiency as a loss of sealing occurs rather often. The frequency of local disintegrations and ruptures of the bellows wall is reduced slightly. The main cause of these deficiencies is non-uniformity of the grained structure of the alloy, arising from the heat treatment in the course of producing bellows. It will be understood that the non-uniformity of the structure of the alloy is responsible for anisotropy of its mechanical properties. This being the case, the bellows wall is sure to have portions of reduced strength. Under operating conditions, these portions are susceptible to cracking. Investigations prove that the size of some grains of the alloy are as high 60 to 80 μm. A loss of sealing is sure to occur in the zone of such a grain when it is considered that the wall thickness of bellows may be as thin as 0.15 μm and even 0.08 μm. The non-unfiformity of the grained structure of the alloy is partly brought about by the non-uniformity of the temperature field in the muffle furnace. However, this is not the only cause.

It is also to be noted that the long residence time of the workpiece in the furnace (3 to 5 hours) is attended with an intensive formation of scale on the bellows wall. In addition, the oxidation processes propagate through the intergranular spaces and in the long run adversely affect the physical and mechanical properties of the alloy.

At the same time, the heat treatment which weakens the reeled tubular workpiece and the thermal stabilization of the corrugated workpiece are indispensible in this case. Otherwise the workpiece wall fails to be plastically deformed in the course of making corrugations and physical and mechanical properties of the alloy fail to meet the predetermined requirements.

SUMMARY OF THE INVENTION

The principal object of the present invention is to provide a method of producing bellows from metal alloys which assures a uniform structure of an alloy in a finished product.

Another object of the present invention is to reduce the percentage of defective products in making whole-drawn bellows.

Still another object of the present invention is to provide a method of producing bellows which assures higher strength and reliability of products.

One more object of the invention is to increase the service life of bellows.

Yet another important object of the invention is to reduce the degree of oxidation of the workpiece in the course of heating.

An additional object of the invention is to provide a more productive method of producing bellows from metal alloys.

The above and other objects of the present invention are attained by a method of producing bellows from metal alloys comprising reeling a tubular workpiece to reduce the wall thickness under volume deformation, heating the reeled tubular workpiece up to a temperature exceeding the recrystallization temperature of the alloy, cooling the heated tubular workpiece, locally deforming the tubular workpiece wall in a transverse direction to form annular grooves therein, making corrugations by plastically deforming the tubular workpiece under axial compression and under excessive internal pressure produced therein, heating the corrugated workpiece to a temperature at which finely dispersed phases of the alloy precipitate at a maximum rate, and holding the workpiece at this temperature. In accordance with to the invention, the reeled tubular workpiece is heated up at a rate of 100° to 800° C. per sec by passing electric current therethrough, and the corrugated workpiece is heated by passing electric current therethrough at a rate of 25° to 100° C. per sec up to a temperature at which finely dispersed phases of the alloy precipitate at a maximum rate, whereupon the workpiece is held at the above temperature for 0.5 to 120 min.

The high rate of heating the tubular workpiece up to the temperature of recrystallization of the alloy provides for both a simultaneous temperature rise throughout the entire volume of the alloy and rapid dissolution of inhibiting phases. Due to the above, equal possibilities are provided for growth of all the grains, and, hence, the grained structure of the alloy turns out to be relatively uniform. The comparatively short time of subjecting the workpiece to elevated temperatures promotes the formation of a close-grained ordered structure of the alloy, which also improves the performance of the bellows. The rapid electric heating of the corrugated workpiece assures intensive thermal fixation and, as a consequence, a higher level of hardening. It is to be noted that the more rapid heating and reduced time of heating essentially prevent the formation of scale, and thus the necessity for chemical etching is obviated. These same factors make for a higher efficiency of the method. As distinct from this, the slow heating in a furnace fails to provide the above advantages.

In order to rule out the possibility of buckling the workpiece, it is advisable that it be subjected to an axial tensile load while being heated to a temperature exceeding the recrystallization temperature of the alloy. The best results are attained when this load is 1 to 5 $Kg/mm^2$.

In producing bellows from nickel-chromium steels and alloys, it is preferable that the reeled tubular workpiece be heated at a rate of 300° to 600° C. per sec to a temperature of 1050° to 1150° C. and then cooled. In this case, the corrugated workpiece is preferably heated to a temperature of 400° to 800° C. and held at this temperature for 0.5 to 60 min.

In producing bellows from a copper-based alloy containing aluminum, nickel, chromium, and manganese in a weight ratio of 6:6:1:4, the rolled tubular workpiece is preferably heated at a rate of 200° to 600° C. per sec to a temperature of 920° to 980° C. and then cooled. In this case, the corrugated workpiece from the above alloy should be preferably heated to a temperature of 470° to 500° C. and held at this temperature for 60 to 120 min.

When producing bellows from beryllium bronze and from brass containing zinc in an amount of 15 to 45% by weight, it is advisable that the reeled tubular workpiece be heated at a rate of 200° to 600° C. per se to a temperature of 760° to 800° C. and then cooled. In this case, the corrugated workpiece from beryllium bronze should preferably be heated to a temperature of 340° to 400° C. and held at this temperature for 4 to 30 min.

DETAILED DESCRIPTION OF THE INVENTION

A method of producing bellows from metal alloys is carried out in the following way. A tubular workpiece is mounted on a mandrel and set in rotation. Simultaneously therewith, balls or rollers of a head movably mounted along the tubular workpiece are brought into contact with the outer surface thereof. In the course of translational movement of the head, the balls or rolls, rotating, reel the tubular workpiece. In consequence of the volume deformation the workpiece wall thickness decreases and the workpiece wall increases. The thus reeled tubular workpiece, according to the invention, is heated at a rate of 100° to 800° C. per sec to a temperature exceeding the recrystallization temperature of the alloy. In particular, if the workpiece is made from a nickel-chromium steel or alloy, it is heated at a rate of 300° to 600° C. to a temperature of 1050° to 1150° C. If the workpiece is made from a copper-based alloy containing aluminum, nickel, chromium, and manganese in a ratio of 6:6:1:4, it is heated at a rate of 200° to 600° C. per sec to a temperature of 920° to 980° C. If the workpiece is made from beryllium bronze or from brass containing zinc in an amount of 15 to 45%, it is heated at a rate of 200° to 600° C. per sec to a temperature of 760° to 800° C. The heating is accomplished by passing an electric current through the reeled workpiece. The heated tubular workpiece is sharply cooled down, for example by quenching it in water. The workpiece may be subjected to such weakening thermal treatment once after reeling, and repeatedly after each stage of reeling (depending on the properties of the alloy and the size of the workpiece).

Thereafter, the workpiece is mounted on a mandrel, and annular grooves are impressed on its wall with the aid of rollers. The inner space of the tubular blank is filled with a fluid, such as oil, and excessive pressure is produced therein. At the same time, the workpiece is compressed an axial direction. As a consequence of the plastic deformation occurring in this case, corrugations are formed. The fluid is discharged from the corrugated workpiece which, according to the invention, is heated at a rate of 25° to 100° C. per sec to a temperature at which finely dispersed phases of the alloy precipitate at a maximum rate, the heating being carried out by passing electric current through the workpiece. According to the invention, the corrugated workpiece is held at the above temperature for 0.5 to 120 min. When producing bellows from nickel-chromium steels and alloys, said corrugated workpiece is heated to a temperature of 400° to 800° C. and held at this temperature for 0.5 to 60 min. If the corrugated workpiece is made from a copper-based alloy containing aluminum, nickel, chromium, and manganese in a weight ratio of 6:6:1:4, it is heated to a temperature of 470° to 500° C. and held at this temperature for 60 to 120 min. If the corrugated workpiece is made from beryllium bronze, it is heated to a temperature of 340° to 400° C. and held at this temperature for 4 to 30 min.

According to the preferred embodiment of the invention, the method is carried out substantially as described above with the difference that the reeled tubular workpiece being heated to a temperature exceeding the recrystallization of the alloy is subjected to an axial tensile load.

Now the invention will be described by way of specific Examples.

EXAMPLE 1

The bellows, according to the invention, were produced from a nickel-chromium alloy containing the following elements, in % by weight:

| | |
|---|---|
| nickel | 36 |
| chromium | 12.2 |
| titanium | 3.0 |
| aluminum | 1.1 |
| manganese | 1.0 |
| silicon | 0.5 |
| sulphur | 0.02 |
| phosphorus | 0.02 |
| carbon | 0.5 |
| iron | the balance |

There were preliminary made workpieces made. For this purpose, 1.5 mm diameter circles were removed from a sheet of the above 1.5 mm thick material. The diameter of the disc was determined proceeding from the equality of volumes of the disc and finished tubular workpiece with due regard for losses and waste.

The above circles were used for making cups. The cups were 12.1 mm long and 46.65 mm across. These cups were drawn out to make tubular workpieces therefrom. The drawing was accomplished in four stages with heat treatment after each stage of the drawing to remove strain hardening and to assure adequate plastic properties of the material, thereby allowing for further deformation of the tubular workpiece. Subsequent to the drawing, the bottoms of the tubular workpieces were cut off, whereupon the sizes of these workpieces were as follows, in mm;

| | |
|---|---|
| diameter | 20.0 |
| wall thickness | 1.5 |
| length | 39.5 |

The above tubular workpieces were reeled to decrease their wall thickness under volume deformation. The reeling of the tubular workpieces was accomplished in 3 stages with heat treatment therebetween. Heat treatment is necessary to ensure plastic properties of the material that make it possible to further deform the tubular workpieces. During the reeling, the wall thickness and the length of the tubular workpieces changed from stage to stage. After the first stage of the reeling, the wall thickness was 1.2 mm and the length, 50 mm; after the second stage of the reeling, the wall thickness was 0.58 mm and the length, 100 mm; after the third stage of the reeling, the wall thickness was 0.16 mm and the length, 310 mm. The reeled tubular workpieces were cut in two, whereupon they were heated at a rate of 500° C. per sec to a temperature of 1120° C., which temperature exceeds that of recrystallization of the alloy. The heating of the tubular workpiece was carried out by passing electric current therethrough.

In the course of heating the reeled tubular workpieces, the latter were subjected to an axial tensile load of 2.5 kg/mm$^2$. The heated tubular workpieces were quenched in water, whereupon the walls thereof were subjected to local transverse deformation to form annular groves throughout the length of the tubular workpieces. The grooves were made by knurling. On each tubular workpiece there were knurled 11 annular grooves with a pitch of 10.4 mm. The width of each annular groove was 1.0 mm and the depth, 0.50 mm.

Thereafter, corrugated workpieces were made from the tubular workpieces with annular grooves. The corrugations were made by plastically deforming the tubular workpieces under axial compression and under excessive internal pressure amounting to 120 kg/cm$^2$. Such being the case, corrugations were extruded on the workpieces. The diameter of the obtained corrugated workpieces was 28 mm, the wall thickness, 0.16 mm, and the number of corrugations on each of the workpieces, 10.

The corrugated workpieces were heated at a rate of 50° C. per sec to a temperature of 730° C., at which temperature finely dispersed phases of the alloy precipitate at a maximum rate. The heating of the corrugated workpieces was carried out by passing electric current therethrough. While being heated, the corrugated workpieces were subjected to an axial tensile strength to attain the predetermined sizes.

The heated corrugated workpieces were at the above temperature of 730° C. for 4 min, whereupon they were cooled to obtain finished bellows.

The thus produced bellows were subjected to testing in order to determine the grain size and microhardness of the material of the tubular workpiece and bellows and also, sealing, permanent deformation, hysteresis, and reliability of the bellows.

Grain size of the material of the bellows was determined on samples cut out from the reeled tubular workpieces after heat treatment. The sample was a ring cut out from the tubular workpieces at a distance of not more than 10 mm from the end thereof, with a 0.8 to 1.0 mm thick cutting disk. The microsection was prepared in the plane of the cut by mechanical grinding and polishing. The grains were detected by etching grain boundaries. The grain size was measured with the aid of an eyepiece micrometer. The diameter of an individual grain (d) was taken as the arithmetic mean of the diameters measured along the long axis ($d_1$) and the short axis ($d_2$): $d=(d_1+d_2)/2$. Several areas of the microsection were examined. With the aid of an eyepiece scale, there were measured the diameters of 5 to 10 grains which visually constituted more than 50% of all the grains of the examined surface of the microsection. The greatest and the least results of the measurements were taken to be indicative of the sizes of the prevailing grain.

The microhardness of the bellows material was determined on samples cut out from the tubular workpieces and bellows and then pressed into polymethylmethacrylate. The surface of the microsection was prepared for measurement by mechanical grinding and polishing. Microhardness was determined from the sizes of the diagonals of the imprint obtained by imprinting a diamond pyramid into the sample at a load of 100 g. The value of microhardness was taken as the arithmetic mean of the results of 10 measurements taken on the high points of any three corrugations (3–4 measurements on each corrugation).

Sealing of the bellows was determined by feeding compressed air thereinto and subsequently submerging the bellows into distilled water for 1 to 2 min. The pressure of the compressed air was 4 kg/cm$^2$ (it should not exceed the maximum operating pressure). With the aid of stops, the bellows were protected from stretching. The absence of bubles in the water and on the surface of the bellows was proof of sealing.

Permanent deformation of the bellows was determined by compressing them through the length of the maximum operating stroke. The bellows were held in the compressed state for not less than 2 min. 5 minutes after removal of the load, the permanent deformation of the bellows was measured with a cathetometer or some other control and measuring instrument ensuring the measurement of movement to an error of not more than 0.2% of the maximum operating stroke.

Hysteresis was determined by registering the elastic characteristic of the bellows which is a relationship between the stroke and load. While increasing the load to a maximum (direct stroke) and while decreasing the same to a minimum (reverse stroke), the elastic characteristic of the bellows was registered at least at five points. The value of hysteresis was determined as a ratio of the greatest difference between the movements of the bellows during the direct and reverse strokes under the same load to the maximum operating stroke. The value of hysteresis was taken as the arithmetic mean of the results of the three measurements.

Reliability of the bellows was determined in the following way. A consignment of bellows to be tested (in an amount of 100) were loaded with alternating internal pressure varying from zero to 45–55% of the maximum operating pressure, depending on the material from which the bellows had been produced. The rate of loading was not higher than 100 cycles per minute. After 50,000 cycles, the number of failures in the consignment of the bellows tested was determined. The term "failure" is used here to denote a loss of sealing.

The results of the tests were as follows:

| | |
|---|---|
| grain size in the material of the tubular workpiece, in μm | 17 to 20 |
| microhardness of the material, in kG/mm$^2$: | |
| of the tubular workpiece | 200 |
| of the bellows | 430 |
| sealing of the bellows, by the presence of bubbles | none |
| permanent deformation of the bellows, in mm | 0 |
| hysteresis of the bellows, in % | 0.16 |
| reliability of the bellows, by the number of failures | 0 |

EXAMPLE 2

The bellows, according to the invention, were produced from the same material and in compliance with the same production procedure as described in Example 1.

However, the reeled tubular workpieces were heated at a rate of 100° C. per sec to a temperature of 1120° C.

The thus produced bellows were tested to determine the grain size and microhardness of the material of the tubular workpieces and, also, the sealing, permanent deformation, hysteresis, and reliability of the bellows. The testing procedure was similar to that described in Example 1.

The results of the tests were as follows:

| | |
|---|---|
| grain size in the material of the tubular workpiece, in μm | 25 to 30 |
| microhardness of the material, in kG/mm$^2$: | |
| of the tubular workpiece | 180 |
| of the bellows | 415 |
| sealing of the bellows, by the presence of bubbles | none |
| permanent deformation of the bellows, in mm | 0.003 |
| hysteresis of the bellows, in % | 0.23 |
| reliability of the bellows, by the number of failures per 50,000 cycles | 0 |

EXAMPLE 3

The bellows, according to the invention, were produced from the same material and in compliance with the same production procedure as described in Example 1.

However, the reeled tubular blanks were heated at a rate of 800° C. per sec to a temperature of 1120° C.

Thus produced bellows were tested to determine the grain size and microhardness of the material of the tubular workpiece and, also, the sealing, permanent deformation, hysteresis, and reliability of the bellows. The testing procedure was similar to that described in Example 1.

The results of the tests were as follows:

| | |
|---|---|
| grain size in the material of the tubular workpiece, in μm | 8 to 10 |
| microhardness of the material, in kg/mm$^2$: | |
| of the tubular workpiece | 220 |
| of the bellows | 440 |
| sealing of the bellows, by the presence of bubbles | none |
| permanent deformation of the bellows, in mm | 0.001 |
| hysteresis of the bellows, in % | 0.11 |
| reliability of the bellows, by the number of failures per 5,000 cycles | 0 |

EXAMPLE 4

(negative)

The bellows were produced from the same material and in compliance with the same production procedure as described in Example 1.

However, the reeled tubular workpieces were heated at a rate of 50° C. per sec (which is lower than the limiting value indicated in the claims of the invention) to a temperature of 1120° C.

The thus produced bellows were tested to determine the grain size and microhardness of the material of the tubular workpiece and, also, the sealing, permanent deformation, hysteresis, and reliability of the bellows. The testing procedure was similar to that described in Example 1.

The results of the tests were as follows:

| | |
|---|---|
| grain size in the material of the tubular workpiece, in μm | 40 to 45 |
| microhardness of the material, in kg/mm$^2$: | |
| of the tubular workpiece | 160 |
| of the bellows | 380 |
| sealing of the bellows, by the presence of bubbles | none |
| permanent deformation of the bellows, in mm | 0.007 |
| hysteresis of the bellows, in % | 0.502 |
| reliability of the bellows, by the number of failures per 50,000 cycles | 0 |

The heating of the workpiece at the above rate leads to heterogeneity in the grain size of the material and, as a consequence, to non-uniform hardening of the finished bellows on the stage of the final heat treatment, thus causing deterioration of the plastic properties of the bellows, increase in the residual deformation and hysteresis.

EXAMPLE 5

(negative)

The bellows were produced from the same material and in compliance with the same production procedure as described in Example 1.

However, as distinct from the invention, the tubular workpieces were heated at a rate of 900° C. per sec.

The material turned out to be too brittle, and the attempts to produce bellows therefrom failed. The grain size of the material of the tubular workpiece was 3 to 5 μm, and the microhardness of the material was 280 kg/mm$^2$.

EXAMPLE 6

The bellows, according to the invention, were produced from the same material and in compliance with the same production procedure as described in Example 1.

However, the reeled tubular workpieces were heated at a rate of 500° C. per sec to a temperature of 1070° C.

Besides, the corrugated workpieces were heated at a rate of 25° C. per sec.

The thus produced bellows were tested to determine the grain size and microhardness of the material of the tubular workpiece and, also, the sealing, permanent deformation, hysteresis, and reliability of the bellows. The testing procedure was similar to that described in Example 1.

The results of the tests were as follows:

| | |
|---|---|
| grain size in the material of the tubular workpiece, in μm | 12 to 15 |
| microhardness of the material, in kg/mm$^2$: | |
| of the tubular workpiece | 210 |
| of the bellows | 415 |
| sealing of the bellows, by the presence of bubbles | none |
| permanent deformation of the bellows, in mm | 0 |
| hysteresis of the bellows, in % | 0.16 |
| reliability of the bellows, by the number of failures per 50,000 cycles | 0 |

EXAMPLE 7

The bellows, according to the invention, were produced from the same material and in compliance with the same production procedure as described in Example 1.

However, the reeled tubular workpieces were heated at a rate of 500° C. per sec to a temperature of 1070° C.

Besides, the corrugated workpieces were heated at a rate of 100° C. per sec.

The thus produced bellows were tested to determine the grain size and microhardness of the material of the tubular workpiece and, also, the sealing, permanent deformation, hysteresis, and reliability of the bellows. The testing procedure was similar to that described in Example 1.

The results of the tests were as follows:

| | |
|---|---|
| grain size in the material of the tubular workpiece, in μm | 12 to 15 |
| microhardness of the material, in kg/mm$^2$: | |
| of the tubular workpiece | 210 |
| of the bellows | 430 |
| sealing of the bellows, by the presence of bubbles | none |
| permanent deformation of the bellows, in mm | 0 |
| hysteresis of the bellows, in % | 0.12 |
| reliability of the bellows, by the number of failures per 50,000 cycles | 0 |

EXAMPLE 8

(negative)

The bellows were produced from the same material and in compliance with the same production procedure as described in Example 6.

However, the corrugated blanks were heated at a rate of 15° C. per sec which is lower than the limiting value indicated in the Claims of the present invention.

The thus produced bellows were tested to determine the grain size and microhardness of the material of the tubular workpiece and, also, the sealing, permanent deformation, hysteresis, and reliability of the bellows. The testing procedure was similar to that described in Example 1.

The results of the tests were as follows:

| | |
|---|---|
| grain size in the material of the tubular workpiece, in μm | 12 to 15 |
| microhardness of the material, in kg/mm$^2$: | |
| of the tubular workpiece | 210 |
| of the bellows | 370 |
| sealing of the bellows, by the presence of the bubbles | none |
| permanent deformation of the bellows, in mm | 0.007 |
| hysteresis of the bellows, in % | 0.507 |
| reliability of the bellows, by the number of failures per 50,000 cycles | 0 |

The low rate of heating the corrugated workpiece leads to a lower level of hardening of the alloy and, hence, reduces the elastic properties of the bellows.

EXAMPLE 9

(negative)

The bellows were produced from the same material and in compliance with the same production procedure as described in Example 6.

However, the corrugated workpieces were heated at a rate of 120° C. per sec.

The thus produced bellows were tested to determine the grain size and microhardness of the material of the tubular workpiece and, also, the sealing, permanent deformation, hysteresis, and reliability of the bellows.

The testing procedure was similar to that described in Example 1.

The results of the tests were as follows:

| | |
|---|---|
| grain size in the material of the tubular workpiece, in μm | 12 to 15 |
| microhardness of the material, in kg/mm$^2$: | |
| of the tubular workpiece | 210 |
| of the bellows | 210 to 440 |
| sealing of the bellows, by the presence of the bubbles | none |
| permanent deformation of the bellows, in mm | 0.01 |
| hysteresis of the bellows, in % | 0.800 |
| reliability of the bellows, by the number of failures per 50,000 cycles | 5 |

The higher rate of heating of the corrugated workpieces caused non-uniform hardening of the material throughout its entire volume. As a result, there appeared internal stresses which adversely affected the reliability and hysteresis of the bellows. Also, there appeared permanent deformation in the bellows.

EXAMPLE 10

The bellows, according to the invention, were produced from stainless steel containing the following elements, in % by weight:

| | |
|---|---|
| carbon | 0.1 |
| chromium | 18.0 |
| nickel | 10.0 |
| titanium | 0.6 |
| molybdenum | 1.5 |
| silicon | 0.8 |
| iron | the balance |

The production procedure of making bellows was similar to that described in Example 1.

However, the reeled tubular workpieces were heated at a rate of 400° C. per sec to a temperature of 1120° C.

Besides, in the course of making corrugated workpieces, the excessive internal pressure produced for extruding corrugations was 130 kg/cm$^2$.

The corrugated workpieces were heated at a rate of 50° C. per sec to a temperature of 520° C. and held at this temperature for 0.5 min.

The thus produced bellows were tested to determine the grain size and microhardness of the material of the tubular workpiece and bellows and, also, the sealing, permanent deformation, hysteresis, and reliability of the bellows.

The testing procedure was similar to that described in Example 1.

The results of the tests were as follows:

| | |
|---|---|
| grain size in the material of the tubular workpiece, in μm | 8 to 10 |
| microhardness of the material, in kg/mm$^2$: | |
| of the tubular workpiece | 220 |
| of the bellows | 380 |
| sealing of the bellows, by the presence of the bubbles | none |
| permanent deformation of the bellows, in mm | 0 |
| hysteresis of the bellows, in % | 0.13 |
| reliability of the bellows, by the number of failures per 50,000 cycles | 0 |

EXAMPLE 11

The bellows, according to the invention, were produced from a copper-based alloy containing the following elements, in % by weight:

| | |
|---|---|
| nickel | 4.6 |
| aluminum | 4.7 |
| manganese | 2.8 |
| chromium | 0.8 |
| copper | the balance |

The tubular workpieces 13.0 mm in diameter, 60 mm in length and 0.4 mm in their-wall thickness were reeled to reduce the wall thickness under volume deformation. The reeling of the tubular workpieces was conducted in two stages without heat treatment therebetween. After the first stage, the wall thickness of the tubular workpieces was 0.24 mm and the length, 84 mm; after the second stage of the reeling, the wall thickness was 0.12 mm and the length, 95 mm.

In other respects, the production procedure of making the bellows and reeled tubular workpieces was substantially similar to that described in Example 1.

However, the tubular workpieces were heated at a rate of 300° C./sec to a temperature of 930° C. In the course of heating, the tubular workpieces were subjected to an axial tensile strength of 1.5 kg/mm$^2$.

On each of the tubular workpieces there were knurled 7 annular grooves with a pitch of 6.6 mm. The width of each knurled annular groove was 0.6 mm and the depth, 0.65 mm.

In the course of making the corrugated workpieces, an excessive internal pressure of 80 kg/cm$^2$ was produced to extrude corrugations. The diameter of the corrugated workpieces was 18 mm, wall thickness, 0.12 mm, and the number of corrugations on each of the workpieces was 6.

The obtained corrugated workpieces were heated at a rate of 50° C. per sec to a temperature of 480° C. and held at this temperature for 120 min.

The thus produced bellows were tested to determine the grain size and microhardness of the material of the tubular workpiece and bellows and, also, the sealing, permanent deformation, hysteresis, and reliability of the bellows. The testing procedure was similar to that described in Example 1.

The results of the tests were as follows:

| | |
|---|---|
| grain size in the material of the tubular workpiece, in μm | 5 to 7 |
| microhardness of the material, in kg/mm$^2$: | |
| of the tubular workpiece | 170 |
| of the bellows | 320 |
| sealing of the bellows, by presence of the bubbles | none |
| permanent deformation of the bellows, in mm | 0 |
| hysteresis of the bellows, in % | 400 |
| reliability of the bellows, by the number of failures per 50,000 cycles | 0 |

EXAMPLE 12

(negative)

The bellows were produced from stainless steel containing the following elements, in % by weight:

| | |
|---|---|
| carbon | 0.1 |
| chromium | 18.0 |
| nickel | 10.0 |
| titanium | 0.6 |
| molybdenum | 1.5 |
| silicon | 0.8 |
| iron | the balance |

The procedure of producing the bellows was substantially similar to that described in Example 1.

However, the corrugated workpieces were heated at a temperature of 520° C. for 0.2 min which is lower than the minimum limit indicated in the claims of the present invention.

The thus produced bellows were tested to determine the grain size and microhardness of the material of the tubular workpiece, bellows and, also, the sealing, permanent deformation, hysteresis, and reliability of the bellows. The testing procedure was similar to that described in Example 1.

The results of the tests were as follows:

| | |
|---|---|
| grain size in the material of the tubular workpiece, in μm | 8 to 10 |
| microhardness of the material, in kg/mm$^2$: | |
| of the tubular workpiece | 220 |
| of the bellows | 340 |
| sealing of the bellows, by the presence of the bubbles | none |
| permanent deformation of the bellows, in mm | 0 |
| hysteresis of the bellows, in % | 0.10 |

-continued

| | |
|---|---|
| reliability of the bellows, by the number of failures per 50,000 cycles | 7 |

The short time of holding the corrugated workpieces at the above temperature does not make it possible to sufficiently relax the internal stresses arising in the course of deformation, which leads to a rapid failure of the bellows.

EXAMPLE 13

(negative)

The bellows were produced from a copper-based alloy described in Example 11.

The tubular workpieces were 13.0 mm in diameter, 60 mm in length, and the wall thickness was 0.4 mm. These tubular workpieces were reeled to reduce their wall thickness under volume deformation. The reeling was carried out in two stages without heat treatment therebetween. After the first stage, the wall thickness of the tubular workpieces was 0.24 mm and the length, 84 mm; after the second stage of reeling, the wall thickness was 0.12 and the length, 95 mm.

Further the procedure of producing bellows and the reeled tubular workpieces was substantially similar to that described in Example 11.

On each of the tubular workpieces there were knurled 7 annular grooves with a pitch of 6.6 mm. The width of each annular groove was 0.6 mm and the depth, 0.65 mm.

So as to extrude corrugations on the workpieces, an excessive internal pressure of 80 kg/cm$^2$ was produced therein. The diameter of the obtained corrugated workpieces was 18 mm, the wall thickness, 0.12 mm, and the number of corrugations on each of the workpieces was 6.

The obtained corrugated workpieces were heated at a rate of 50° C. per sec to a temperature of 480° C. and held at this temperature for 150 min.

The thus produced bellows were tested to determine the grain size and microhardness of the material of the tubular workpiece and bellows and, also, the sealing, permanent deformation, hysteresis, and reliability of the bellows. The testing procedure was similar to that described in Example 1.

The results of the tests were as follows:

| | |
|---|---|
| grain size in the material of the tubular workpiece, in μm | 5 to 7 |
| microhardness of the material, in kg/mm$^2$: | |
| of the tubular workpiece | 170 |
| of the bellows | 270 |
| sealing of the bellows, by the presence of the bubbles | none |
| permanent deformation of the bellows, in mm | 0.003 |
| hysteresis of the bellows, in % | 1.5 |
| reliability of the bellows, by the number of failures per 50,000 cycles | 0 |

The prolonged heating of the corrugated workpieces at the above temperature resulted in a considerable coagulation of particles of finely divided phases and adversely affected the elasticity of the bellows and, particularly, hysteresis.

EXAMPLE 14

The bellows, according to the invention, were produced from a copper-based alloy described in Example 11.

The tubular workpieces being 13.0 mm in diameter, 60 mm in length, and 0.4 mm in wall thickness were reeled to reduce the wall thickness under volume deformation. The reeling was carried out in two stages without heat treatment therebetween. After the first stage, the wall thickness of the tubular workpieces was 0.24 mm and the length, 84 mm. After the second stage of reeling, the wall thickness was 0.12 mm and the length, 95 mm.

Further the procedure of producing bellows and the reeled tubular workpieces was substantially similar to that described in Example 1.

However the tubular workpieces were heated at a rate of 300° C. per sec to a temperature of 930° C. While being heated, the tubular workpieces were subjected to a tensile load equal to 1 kg/mm$^2$.

On each of the tubular workpieces there were knurled 7 annular grooves with a pitch of 6.6 mm. The width of each annular groove was 0.6 mm and the depth, 0.65 mm.

So as to extrude corrugations on the workpieces, an excessive internal pressure of 80 kg/cm$^2$ was produced therein. The diameter of the obtained corrugated workpieces was 18 mm, the wall thickness, 0.12 mm, and the number of corrugations on each of the workpieces was 6.

The obtained corrugated workpieces were heated at a rate of 50° C. per sec to a temperature of 480° C. and held at this temperature for 90 min.

The thus produced bellows were tested to determine the grain size and microhardness of the material of the tubular workpieces and bellows and, also, the sealing, permanent deformation, hysteresis, and reliability of the bellows. The testing procedure was similar to that described in Example 1.

The results of the tests were as follows:

| | |
|---|---|
| grain size in the material of the tubular workpiece, in μm | 5 to 7 |
| microhardness of the material, in kg/mm$^2$: | |
| of the tubular workpiece | 170 |
| of the bellows | 320 |
| sealing of the bellows, by the presence of the bubbles | none |
| permanent deformation of the bellows, in mm | 0 |
| hysteresis of the bellows, in % | 0.2 |
| reliability of the bellows, by the number of failures per 50,000 cycles | 0 |

EXAMPLE 15

The bellows, according to the invention were produced from the same material and in compliance with the same production procedure as described in Example 1.

However, when heating the reeled tubular workpieces, the latter were subjected to an axial tensile load equal to 5 kg/mm$^2$.

The thus produced bellows were tested to determine the grain size and microhardness of the material of the tubular workpiece and bellows and, also, the sealing, permanent deformation, hysteresis, and reliability of the bellows. The testing procedure was similar to that described in Example 1.

The results of the test were as follows:

| | |
|---|---|
| grain size in the material of the tubular workpiece, in μm | 17 to 20 |
| microhardness of the material, in kg/mm$^2$: | |
| of the tubular workpiece | 200 |

-continued

| | |
|---|---|
| of the bellows | 430 |
| sealing of the bellows, by the presence of bubbles | none |
| permanent deformation of the bellows, in mm | 0 |
| hysteresis of the bellows, in % | 0.16 |
| reliability of the bellows, by the number of failures per 50,000 cycles | 0 |

EXAMPLE 16

(negative)

The bellows were produced from the same material and in compliance with the production procedure described in Example 1.

However, when heating the reeled tubular workpieces, they were subjected to an axial tensile load equal to 0.5 kg/mm$^2$ which is lower than the minimum limit indicated in the claims of the present invention.

The above magnitude of the axial tensile load acting upon the tubular workpiece makes them corrugate and thus precludes their utilization for the production of bellows.

EXAMPLE 17

(negative)

The bellows were produced from the same material and in compliance with the production procedure described in Example 1.

However, as distinct from the invention, the reeled tubular workpieces, while being heated, were subjected to an axial tensile load equal to 7 kg/mm$^2$.

The attempts to produce bellows failed on account of the deformation and rupture of the tubular workpieces.

EXAMPLE 18

The bellows, according to the invention, were produced from the same material and in compliance with the same production procedure as those described in Example 1.

However, the reeled tubular workpieces were heated at a rate of 300° per sec to a temperature of 1050° C.

The thus produced bellows were tested to determine the grain size and microhardness of the material of the tubular workpiece and bellows and, also, the sealing, permanent deformation, hysteresis, and reliability of the bellows. The testing procedure was similar to that described in Example 1.

The results of the test were as follows:

| | |
|---|---|
| grain size in the material of the tubular workpiece, in μm | 10 to 12 |
| microhardness of the material, in kg/mm$^2$: | |
| of the tubular workpiece | 210 |
| of the bellows | 430 |
| sealing of the bellows, by the presence of bubbles | none |
| permanent deformation of the bellows, in mm | 0 |
| hysteresis of the bellows, in % | 0.12 |
| reliability of the bellows, by the number of failures per 50,000 cycles | 0 |

EXAMPLE 19

The bellows, according to the invention, were produced from the same material and in compliance with the same production procedure as those described in Example 1.

However, the tubular workpieces were heated at a rate of 600° C. per sec to a temperature of 1150° C.

Thus produced bellows were tested to determine the grain size and microhardness of the material of the tubular workpiece and bellows and, also, the sealing, permanent deformation, hysteresis, and reliability of the bellows. The testing procedure was similar to that described in Example 1.

The results of the tests were as follows:

| | |
|---|---|
| grain size in the material of the tubular workpiece, in μm | 20 to 25 |
| microhardness of the material, in kg/mm$^2$: | |
| of the tubular workpiece | 190 |
| of the bellows | 415 |
| sealing of the bellows, by the presence of the bubbles | none |
| permanent deformation of the bellows in mm | 0 |
| hysteresis of the bellows, in % | 0.20 |
| reliability of the bellows, by the number of failures per 50,000 cycles | 0 |

EXAMPLE 20

(negative)

The bellows were produced from the same material and in compliance with the same production procedure described in Example 18.

However, the reeled tubular workpieces were heated to a temperature of 1000° C. which is lower than the minimum limit indicated in the Claims of the present invention.

The heating of the tubular workpieces to the above temperature fails to ensure the complete recrystallization of the material, which eliminates the possibility of producing bellows therefrom.

EXAMPLE 21

(negative)

The bellows were produced from the same material and in compliance with the same production procedure described in Example 1.

However, the reeled tubular workpieces were heated at a rate of 300° C. per sec. As distinct from the invention, these were heated to a temperature of 1200° C.

The above elevated temperature caused fusion of the grains of the material and, thus, the further production procedure aimed at producing bellows from the obtained tubular workpieces proved to be a failure.

EXAMPLE 22

The bellows, according to the invention were produced from stainless steel containing the following elements, in % by weight:

| | |
|---|---|
| carbon | 0.1 |
| chromium | 18.0 |
| nickel | 10.0 |
| titanium | 0.6 |
| molybdenum | 1.5 |
| silicon | 0.8 |
| iron | the balance |

The procedure of producing bellows was similar to that described in Example 10.

However, the corrugated workpieces were heated at a rate of 50° C. to a temperature of 400° and held at this temperature for 60 min.

The thus produced bellows were tested to determine the grain size and microhardness of the material of the tubular workpiece and bellows and, also, the sealing, permanent deformation, hysteresis, and reliability of the bellows. The testing procedure was similar to that described in Example 1.

The results of the tests were as follows:

| | |
|---|---|
| grain size in the material of the tubular workpiece, in μm | 8 to 10 |
| microhardness of the material, in kg/mm$^2$: | |
| of the tubular workpiece | 220 |
| of the bellows | 345 |
| sealing of the bellows, by the presence of bubbles | none |
| permanent deformation of the bellows, in mm | 0 |
| hysteresis of the bellows, in % | 0.11 |
| reliability of the bellows, by the number of failures per 50,000 cycles | 0 |

EXAMPLE 23

The bellows, according to the invention, were produced from stainless steel described in Example 22.

The procedure of producing bellows was similar to that described in Example 10.

However, the corrugated workpieces were heated at a rate of 100° C. per sec to a temperature of 800° C. and held at this temperature for 0.5 min.

The thus produced bellows were tested to determine the grain size and microhardness of the material of the tubular workpiece and bellows and, also, sealing, permanent deformation, hysteresis, and reliability of the bellows. The testing procedure was similar to that described in Example 1.

The results of the tests were as follows:

| | |
|---|---|
| grain size in the material of the tubular workpiece, in μm | 8 to 10 |
| microhardness of the material, in kg/mm$^2$: | |
| of the tubular workpiece | 220 |
| of the bellows | 330 |
| sealing of the bellows, by the presence of bubbles | none |
| permanent deformation of the bellows, in mm | 0 |
| hysteresis of the bellows, in % | 0.30 |
| reliability of the bellows, by the number of failures per 50,000 cycles | 0 |

EXAMPLE 24

(negative)

The bellows were produced from stainless steel described in Example 22.

The procedure of producing bellows was similar to that described in Example 10.

However, the corrugated workpieces were heated at a rate of 50° C. to a temperature of 300° C. which is lower than the minimum limit indicated in the claims of the present invention and held at this temperature for 60 min.

The thus produced bellows were tested to determine the grain size and microhardness of the material of the tubular workpiece and bellows and, also, sealing, permanent deformation, hysteresis, and reliability of the bellows. The testing procedure was similar to that described in Example 1.

The results of the tests were as follows:

| | |
|---|---|
| grain size in the material of the tubular workpiece, in μm | 8 to 10 |
| microhardness of the material, in kg/mm$^2$: | |
| of the tubular workpiece | 220 |
| of the bellows | 350 |
| sealing of the bellows, by the presence of the bubbles | none |
| permanent deformation of the bellows, in mm | 0 |
| hysteresis of the bellows, in % | 0.09 |

-continued

| | |
|---|---|
| reliability of the bellows, by the number of failures per 50,000 cycles | 4 |

The heating of the corrugated workpieces to the above temperature results in an incomplete relaxation of the internal strains in the material of the finished bellows. This brings about heterogeneity in the properties of the material of the bellows and thus a premature failure of the latter.

EXAMPLE 25

(negative)

The bellows were produced from stainless steel described in Example 22.

The procedure of producing bellows was similar to that described in Example 10.

However, the corrugated workpieces were heated at a rate of 50° C. to a temperature of 900° C. and held at this temperature for 0.5 min.

The thus produced bellows were tested to determine the grain size and microhardness of the material of the tubular workpiece and bellows and, also, sealing, permanent deformation, hysteresis, and reliability of the bellows. The testing procecure was similar to that described in Example 1.

The results of the tests were as follows:

| | |
|---|---|
| grain size in the material of the tubular workpiece, in μm | 8 to 10 |
| microhardness of the material, in kg/mm$^2$: | |
| of the tubular workpiece | 220 |
| of the bellows | 250 |
| sealing of the bellows, by the presence of the bubbles | none |
| permanent deformation of the bellows, in mm | 0.02 |
| hysteresis of the bellows, in % | 1.2 |
| reliability of the bellows, by the number of failures per 50,000 cycles | 10 |

The elevated temperature of heating caused recrystallization in the bellows material. As a consequence, the strength and elasticity of the material turned out to be considerably deteriorated, as shown by the above data.

EXAMPLE 26

The bellows, according to the invention, were produced from a copper-based alloy described in Example 11.

The procedure of producing bellows and reeled tubular workpieces was substantially similar to that described in Example 11.

However, the tubular workpieces were heated at a rate of 200° C. per sec to a temperature of 920° C.

Also, the obtained corrugated workpieces were heated at a rate of 50° C. per sec to a temperature of 480° C. and held at this temperature for 90 min.

The thus produced bellows were tested to determine the grain size and microhardness of the material of the tubular workpiece and bellows and, also, sealing, permanent deformation, hysteresis, and reliability of the bellows. The testing procedure was similar to that described in Example 1.

The results of the tests were as follows:

| | |
|---|---|
| grain size in the material of the tubular workpiece, in μm | 6 to 9 |
| microhardness of the material, in kg/mm$^2$: | |
| of the tubular workpiece | 160 |

-continued

| | |
|---|---|
| of the bellows | 310 |
| sealing of the bellows, by the presence of the bubbles | none |
| permanent deformation of the bellows, in mm | 0 |
| hysteresis of the bellows, in % | 0.420 |
| reliability of the bellows, by the number of failures per 50,000 cycles | 0 |

EXAMPLE 27

The bellows, according to the invention, were produced from a copper-based alloy described in Example 11.

The procedure of producing bellows and reeled tubular workpieces was substantially similar to that described in Example 11.

However, the tubular workpieces were heated at a rate of 600° C. per sec to a temperature of 980° C.

Also, the obtained corrugated workpieces were heated at a rate of 50° C. to a temperature of 480° C. and held at this temperature for 90 min.

The thus produced bellows were tested to determine the grain size and microhardness of the material of the tubular workpiece and bellows and, also, sealing, permanent deformation, hysteresis, and reliability of the bellows. The testing procedure was similar to that described in Example 1.

The results of the tests were as follows:

| | |
|---|---|
| grain size in the material of the tubular workpiece, in μm | 6 to 9 |
| microhardness of the material, in kg/mm$^2$: | |
| of the tubular workpiece | 160 |
| of the bellows | 300 |
| sealing of the bellows, by the presence of bubbles | none |
| permanent deformation of the bellows, in mm | 0 |
| hysteresis of the bellows, in % | 0.450 |
| reliability of the bellows, by the number of failures per 50,000 cycles | 0 |

EXAMPLE 28

(negative)

The bellows were produced from a copper-based alloy described in Example 11.

The procedure of producing reeled tubular workpieces was substantially similar to that described in Example 11.

However, the tubular workpieces were heated at a rate of 200° C. per sec to a temperature of 350° C. which is lower than the minimum limit indicated in the Claims of the present invention.

The heating of the tubular workpieces to the above temperature does not assure the complete recrystallization of the material, which makes it almost impossible to make bellows therefrom.

EXAMPLE 29

(negative)

The bellows were produced from a copper-based alloy described in Example 11.

The procedure of making reeled tubular workpieces was substantially similar to that described in Example 11.

However, the tubular workpieces were heated at a rate of 200° C. per sec up to a temperature of 1020° C. While being heated, the tubular workpieces were subjected to an axial tensile load equal to 1.5 k/mm.

The elevated temperature caused the fusion of grains in the material of the workpieces, and, hence, the attempts to produce bellows therefrom failed.

EXAMPLE 30

The bellows, according to the invention, were produced from a copper-based alloy described in Example 11.

The procedure of producing bellows and reeled tubular workpieces was substantially similar to that described in Example 11.

However, the tubular workpieces were heated at a rate of 300° C. per sec to a temperature 930° C.

Also, the obtained corrugated workpieces were heated at a rate of 50° C. per sec to a temperature of 470° C. and held at this temperature for 120 min.

The thus produced bellows were tested to determine the grain size and microhardness of the material in the tubular workpiece and bellows and, also, sealing, permanent deformation, hysteresis, and reliability of the bellows. The testing procedure was similar to that described in Example 1.

The results of the tests were as follows:

| | |
|---|---|
| grain size in the material of the tubular workpiece, in μm | 5 to 7 |
| microhardness of the material, in kg/mm$^2$: | |
| of the tubular workpieces | 170 |
| of the bellows | 320 |
| sealing of the bellows, by the presence of bubbles | none |
| permanent deformation of the bellows, in mm | 0 |
| hysteresis of the bellows, in % | 0,400 |
| reliability of the bellows, by the number of failures per 50,000 cycles | 0 |

EXAMPLE 31

The bellows, according to the invention, were produced from a copper-based alloy described in Example 11.

The procedure of producing bellows and reeled tubular workpieces was substantially similar to that described in Example 11.

However, the tubular workpieces were heated at a rate of 300° C. per sec to a temperature of 930° C.

The obtained corrugated workpieces were heated at a rate of 50° C. per sec to a temperature of 500° C. and held at this temperature for 600 min.

The thus produced bellows were tested to determine the grain size and microhardness of the material of the tubular workpiece and bellows and, also, sealing, permanent deformation, hysteresis, and reliability of the bellows. The testing procedure was substantially similar to that described in Example 1.

The results of the tests were as follows:

| | |
|---|---|
| grain size in the material of the tubular workpiece, in μm | 5 to 7 |
| microhardness of the material, in kg/mm$^2$: | |
| of the tubular workpiece | 170 |
| of the bellows | 300 |
| sealing of the bellows, by the presence of the bubbles | none |
| permanent deformation of the bellows, in mm | 0 |
| hysteresis of the bellows, in % | 0.300 |
| reliability of the bellows, by the number of failures per 50,000 cycles | 0 |

EXAMPLE 32

(negative)

The bellows were produced from a copper-based alloy described in Example 11.

The procedure of producing bellows and reeled tubular workpieces was substantially similar to that described in Example 11.

However, the obtained corrugated workpieces were heated at a rate of 50° C. per sec to a temperature of 400° C. which is lower than the minimum limit indicated in the claims of the present invention and held at this temperature for 60 min.

The thus produced bellows were tested to determine the grain size and microhardness of the material of the tubular workpiece and bellows and, also, sealing, permanent deformation, hysteresis, and reliability of the bellows. The testing procedure was similar to that described in Example 1.

The results of the tests were as follows:

| | |
|---|---|
| grain size in the material of the tubular workpiece, in μm | 5 to 7 |
| microhardness, in kg/mm$^2$: | |
| of the tubular workpiece | 170 |
| of the bellows | 230 |
| sealing of the bellows, by the presence of the bubbles | none |
| permanent deformation of the bellows, in mm | 0.07 |
| hysteresis of the bellows, in % | 1.7 |
| reliability of the bellows, by the number of failures per 50,000 cycles | 15 |

The heating of the corrugated workpieces to the above temperature results in the level of strength and elasticity of the material being lower than necessary.

EXAMPLE 33

(negative)

The bellows were produced from a copper-based alloy described in Example 11.

The procedure of producing bellows and reeled tubular workpieces was substantially similar to that described in Example 11.

The obtained corrugated workpieces were heated at a rate of 50° C. per sec to a temperature of 550° C. and held at this temperature for 120 min. The temperature of heating was selected as distinct from the invention.

The thus produced bellows were tested to determine the grain size and microhardness of the material of the tubular workpiece and bellows and, also, sealing, permanent deformation, hysteresis, and reliability of the bellows. The testing procedure was similar to that described in Example 1.

The results of the tests were as follows:

| | |
|---|---|
| grain size in the material of the tubular workpiece, in μm | 5 to 7 |
| microhardness, in kg/mm$^2$: | |
| of the tubular workpiece | 170 |
| of the bellows | 200 |
| sealing of the bellows, by the presence of the bubbles | none |
| permanent deformation of the bellows, in mm | — |
| hysteresis of the bellows, in % | — |
| reliability of the bellows, by the number of failures per 50,000 cycles | — |

Permanent deformation, hysteresis and reliability of the bellows could not be determined, since, because of the elevated temperature, the material of the bellows acquired the capacity to be plastically deformed.

EXAMPLE 34

The bellows, according to the invention, were produced from bronze containing the following elements, in weight %:

| | |
|---|---|
| beryllium | 2.0 |
| nickel | 0.27 |
| copper | the balance |

The procedure of producing bellows and reeled tubular workpieces was substantially similar to that described in Example 1.

40 mm diameter circles were cut from a 1.5 mm thick sheet. The circles were rolled into cups of 26 mm diameter and 32 mm length. These cups were drawn out to make tubular workpieces therefrom. The drawing was accomplished in 3 stages. The sizes of the obtained tubular workpieces were as follows, in mm:

| | |
|---|---|
| diameter | 13 |
| wall thickness | 1.5 |
| length | 40 |

The above tubular workpieces were reeled to reduce the wall thickness under volume deformation, the reeling being accomplished in 3 stages. After the first stage, the wall thickness of the tubular workpieces was 0.75 mm and the length, 70 mm. After the second stage, the wall thickness was 0.36 mm and the length, 110 mm. After the third stage, the wall thickness was 0.12 mm, and the length, 190 mm.

The reeled tubular workpieces were cut in two and then heated at a rate of 200° C. per sec to a temperature of 760° C. While being heated, the workpieces were subjected to an axial tensile load equal to 1.5 kg/mm$^2$.

On each tubular workpiece, there were knurled 7 annular grooves with a pitch of 6.6 mm, the width of each knurled annular groove being 0.6 mm, and the depth, 0.65 mm.

In the course of producing corrugated workpieces, an excessive internal pressure equal to 100 kg/cm$^2$ was produced within the workpieces, and thus corrugations were extruded thereon. The diameter of the obtained corrugated workpieces was 18 mm, the wall thickness, 0.12 mm, and the number of corrugations on each of the workpieces, 6.

The obtained corrugated workpieces were heated at a rate of 50° C. per sec to a temperature of 370° C. and held at this temperature for 10 min.

The thus produced bellows were tested to determine the grain size and microhardness of the material of the tubular workpiece and bellows and, also, sealing, permanent deformation, hysteresis, and reliability of the bellows. The testing procedure was similar to that described in Example 1.

The results of the tests were as follows:

| | |
|---|---|
| grain size in the material of the tubular workpiece, in μm | 12 to 14 |
| microhardness of the material, in kg/mm$^2$: | |
| of the tubular workpiece | 130 |
| of the bellows | 410 |
| sealing of the bellows, by the presence of the bubbles | none |
| permanent deformation of the bellows, in mm | 0 |
| hysteresis of the bellows, in % | 0.002 |
| reliability of the bellows, by the number of failures | |

-continued

| | |
|---|---|
| per 50,000 cycles | 0 |

EXAMPLE 35

The bellows, according to the invention, were produced from brass containing the following elements, in weight %:

| | |
|---|---|
| zinc | 20.0 |
| copper | the balance |

The procedure of producing bellows was substantially similar to that of Example 1.

40 mm diameter circles were cut from a 1.0 mm thick sheet. The circles were rolled into cups of 26 mm diameter and 32 mm length.

The above cups were drawn out to make tubular workpieces. The drawing was accomplished in 3 stages. The sizes of the obtained workpieces were as follows, in mm:

| | |
|---|---|
| diameter | 13 |
| wall thickness | 1.0 |
| length | 40 |

The above tubular workpieces were reeled to reduce the wall thickness thereof under volume deformation, the reeling being accomplished in 2 stages. After the first stage, the wall thickness of the tubular workpieces was 0.40 mm and the length, 110 mm; after the second stage, the wall thickness was 0.12 mm and the length, 250 mm.

The reeled tubular workpieces were cut in two and then heated at a rate of 600° C. per sec to a temperature of 800° C. While being heated, the workpieces were subjected to an axail tensile load equal to 1.5 kg/mm$^2$.

On each tubular workpiece, there were knurled 7 annular grooves with a pitch of 6.6 mm. The width of each knurled annular groove being 0.6 mm, and the depth, 0.65 mm.

In the course of producing corrugated workpieces, an excessive internal pressure equal to 100 kg/cm$^2$ was produced within the workpieces, and thus corrugations were extruded thereon. The diameter of the obtained corrugated workpieces was 18 mm, the wall thickness, 0.12 mm, and the number of corrugations on each of the workpieces was 6.

The obtained corrugated workpieces were heated at a rate of 50° C. per sec to a temperature of 240° C. and held at this temperature for 5 min.

The thus produced bellows were tested to determine the grain size and microhardness of the material of the tubular workpiece and bellows and, also, sealing, permanent deformation, hysteresis, and reliability of the bellows. The testing procedure was similar to that described in Example 1.

The results of the tests were as follows:

| | |
|---|---|
| grain size in the material of the tubular workpiece, in μm | 15 to 18 |
| microhardness of the material of the bellows, in kg/mm$^2$ | 140 |
| sealing of the bellows, by the presence of the bubbles | none |
| permanent deformation of the bellows, in mm | 0.001 |
| hysteresis of the bellows, in % | 0.12 |
| reliability of the bellows, by the number of failures per 50,000 cycles | 0 |

EXAMPLE 36

(negative)

The bellows were produced from bronze described in Example 34. The reeled tubular workpieces were cut in two and heated at a rate of 200° C. per sec to a temperature of 700° C. While being heated, the workpieces were subjected to an axial tensile load equal to 1.5 kg/mm$^2$.

The temperature of heating proved to be insufficient for a complete recrystallization of the bronze. As a result, the production process turned out to be without success.

EXAMPLE 37

(negative)

The bellows were produced from brass as described in Example 35. The procedure of producing bellows was substantially similar to that described in Example 35.

The reeled tubular workpieces were cut in two and then heated at a rate of 200° C. per sec to a temperature of 900° C. While being heated, the workpieces were subjected to an axial tensile load equal to 1.5 kg/mm$^2$.

The tests showed that at the above temperature the material was fused at the grain boundary. Hence, the workpieces turned out to be unsuitable for making bellows.

EXAMPLE 38

The bellows, according to the invention, were produced from bronze described in Example 34.

The procedure of producing bellows was substantially similar to that described in Example 34.

However, the reeled tubular workpieces were heated at a rate of 300° C. per sec to a temperature of 770° C.

Also, the obtained corrugated workpieces were heated at a rate of 50° C. per sec to a temperature of 340° C. and held at this temperature for 30 min.

The thus produced bellows were tested to determine the grain size and microhardness of the material of the tubular workpiece and bellows and, also, sealing, permanent deformation, hysteresis, and reliability of the bellows. The testing procedure was similar to that described in Example 1.

The results of the tests were as follows:

| | |
|---|---|
| grain size in the material of the tubular workpiece, in μm | 10 to 12 |
| microhardness of the material of the bellows, in kg/mm$^2$: | |
| of the tubular workpiece | 130 |
| of the bellows | 370 |
| sealing of the bellows, by the presence of the bubbles | none |
| permanent deformation of the bellows, in mm | 0 |
| hysteresis of the bellows, in % | 0.002 |
| reliability of the bellows, by the number of failures per 50,000 cycles | 0 |

EXAMPLE 39

The bellows, according to the invention, were produced from bronze described in Example 34.

The procedure of producing bellows was substantially similar to that described in Example 38.

However, the obtained corrugated workpieces were heated at a rate of 50° C. per sec to a temperature of 400° C. and held at this temperature for 4 min.

The thus produced bellows were tested to determine the grain size and microhardness of the material of the tubular workpiece and bellows and, also, sealing, permanent deformation, hysteresis, and reliability of the bellows. The testing procedure was similar to that described in Example 1.

The results of the tests were as follows:

| | |
|---|---|
| grain size in the material of the tubular workpiece, in μm | 10 to 12 |
| microhardness of the material, in kg/mm²: | |
| of the tubular workpiece | 130 |
| of the bellows | 350 |
| sealing of the bellows, by the presence of the bubbles | none |
| permanent deformation of the bellows, in mm | 0 |
| hysteresis of the bellows, in % | 0.004 |
| reliability of the bellows, by the number of failures per 50,000 cycles | 0 |

EXAMPLE 40

(negative)

The bellows were produced from bronze described in Example 34.

The procedure of producing bellows was substantially similar to that described in Example 38.

However, as distinct from the invention, the obtained corrugated workpieces were heated up to a temperature of 300° C. and held at this temperature.

The thus produced bellows were tested to determine the grain size and microhardness of the material of the tubular workpiece and bellows and, also, sealing, permanent deformation, hysteresis, and reliability of the bellows. The testing procedure was similar to that described in Example 1.

The results of the tests were as follows:

| | |
|---|---|
| grain size in the material of the tubular workpiece, in μm | 10 to 12 |
| microhardness of the material, in kg/mm²: | |
| of the tubular workpiece | 130 |
| of the bellows | 350 |
| sealing of the bellows, by the presence of the bubbles | none |
| permanent deformation of the bellows, in mm | 0 |
| hysteresis of the bellows, in % | 0.004 |
| reliability of the bellows, by the number of failures per 50,000 cycles | 0 |

EXAMPLE 40

(negative)

The bellows were produced from bronze described in Example 34.

The procedure of producing bellows was substantially similar to that described in Example 38.

However, as distinct from the invention, the obtained corrugated workpieces were heated up to a temperature of 300° C. and held at this temperature.

The thus produced bellows were tested to determine the gain size and microhardness of the material of the tubular workpiece and bellows and, also, sealing, permanent deformation, hysteresis, and reliability of the bellows. The testing procedure was similar to that described in Example 1.

The results of the tests were as follows:

| | |
|---|---|
| grain size in the material of the tubular workpiece, in μm | 10 to 12 |
| microhardness of the material, in kg/mm²: | |
| of the tubular workpiece | 130 |
| of the bellows | 300 |
| sealing of the bellows, by the presence of the bubbles | none |
| permanent deformation of the bellows, in mm | 0.007 |
| hysteresis of the bellows, in % | 0.57 |
| reliability of the bellows, by the number of failures per 50,000 cycles | 3 |

The temperature of heating of the corrugated workpiece proved to be insufficient for the complete precipitation of the finely dispersed hardening phase in the bronze. As a result, the required strength and elasticity were not attained, which can be seen from the results of the tests.

EXAMPLE 41

(negative)

The bellows were produced from the bronze described in Example 34.

The procedure of producing bellows was substantially similar to that described in Example 38.

However, the obtained corrugated bellows were heated to a temperature of 450° C. which is higher than the maximum value indicated in the claims of the invention and held at this temperature for 15 min.

The thus produced bellows were tested to determine the grain size and microhardness of the material of the tubular workpieces and bellows and, also, sealing, permanent deformation, hysteresis, and reliability of the bellows. The testing procedure was similar to that described in Example 1.

The results of the tests were as follows:

| | |
|---|---|
| grain size in the material of the tubular workpiece, in μm | 10 to 12 |
| microhardness of the material, in kg/mm²: | |
| of the tubular workpiece | 130 |
| of the bellows | 250 |
| sealing of the bellows, by the presence of the bubbles | none |

The heating of the corrugated workpieces up to the above temperature results in the deterioration of plasticity of the bellows. The obtained bellows are plastically deformed when being tested, which makes it impossible to determine such properties as permanent deformation, hysteresis, and reliability.

While particular embodiments of the invention have been described, it will be understood that various modifications may be made in the invention without departing from the spirit of the following claims.

We claim:

1. A method of producing bellows from metal alloys comprising:

(a) reeling a tubular workpiece to decrease the wall thickness thereof under volume deformation;

(b) heating said reeled tubular workpiece at a rate of 100° to 800° C. per sec up to a temperature exceeding that of recrystallization of the alloy, the heating process being carried out by passing electric current through said tubular workpiece;

(c) cooling said heated tubular workpiece down;

(d) locally deforming the tubular workpiece wall in transverse direction to form annular grooves therein;

(e) making corrugations by plastically deforming said tubular workpiece under axial compression and under excessive internal pressure produced therein;

(f) heating the obtained corrugated workpiece at a rate of 25° to 100° C. per sec to a temperature at which finely dispersed phases of the alloy precipitate at a maximum rate, the heating process being carried out by passing electric current through said corrugated workpiece;

(g) holding said corrugated workpiece for a time period of 0.5 to 120 min, during which time period finely dispersed phases of the alloy precipitate at a maximum rate.

2. A method as claimed in claim 1, wherein said tubular workpiece being heated up to a temperature exceeding that of recrystallization of the alloy is subjected to an axial tensile load.

3. A method as claimed in claim 2, wherein said reeled tubular workpiece is subjected to an axial tensile load of 1 to 5 k/mm$^2$.

4. A method as claimed in claim 1, wherein in producing bellows from nickel-chromium steels and alloys, said reeled tubular workpiece is heated at a rate of 300° to 600° C. per sec up to a temperature of 1050° to 1150° C. and then cooled down.

5. A method as claimed in claim 1, wherein in producing bellows from nickel-chromium steels and alloys, said corrugated workpiece is heated up to a temperature of 400° to 800° C. and held at this temperature for 0.5 to 60 min.

6. A method as claimed in claim 1, wherein in producing bellows from a cooper-based alloy containing aluminium, nickel, chromium, and manganese in the weight ratio of 6:6:1:4, said reeled tubular workpiece is heated at a rate of 200° to 600° C. per sec up to a temperature of 920° to 980° C. and then cooled down.

7. A method as claimed in claim 6, wherein said corrugated workpiece made from the above alloy is heated to a temperature of 470° to 500° C. and held at this temperature for 60 to 120 min.

8. A method as claimed in claim 1, wherein in producing bellows from beryllium bronze and from brass containing zink in an amount of 15 to 45% by weight, the reeled tubular workpiece is heated at a rate of 200° to 600° C. per sec up to a temperature of 760° to 800° C. and then cooled down.

9. A method as claimed in claim 1, wherein in producing bellows from beryllium bronze, the corrugated workpiece is heated up to a temperature of 340° to 400° C. and then held at this temperature for 4 to 30 min.

* * * * *